US010219959B1

(12) United States Patent
Phillips

(10) Patent No.: US 10,219,959 B1
(45) Date of Patent: Mar. 5, 2019

(54) MOVABLE SANITARY STATION FOR USE WITH HOSPITAL BED AND METHOD FOR PROVIDING PATIENT SANITATION

(71) Applicant: Comfort Master Holdings, LLC, Danielsville, GA (US)

(72) Inventor: C J Phillips, Danielsville, GA (US)

(73) Assignee: COMFORT MASTER HOLDINGS, LLC, Danielsville, GA (US)

( * ) Notice: Subject to any disclaimer, the term of this patent is extended or adjusted under 35 U.S.C. 154(b) by 0 days.

(21) Appl. No.: 15/791,624

(22) Filed: Oct. 24, 2017

(51) Int. Cl.

| | |
|---|---|
| ***A61G 7/02*** | (2006.01) |
| ***A61G 9/00*** | (2006.01) |
| ***A47K 4/00*** | (2006.01) |
| ***A47K 13/00*** | (2006.01) |
| ***A47K 3/28*** | (2006.01) |

(52) U.S. Cl.
CPC ..... *A61G 7/02* (2013.01); *A47K 3/28* (2013.01); *A47K 4/00* (2013.01); *A47K 13/00* (2013.01); *A61G 9/006* (2013.01)

(58) Field of Classification Search
CPC ..... A61G 7/02
USPC ..... 4/457, 449, 480
See application file for complete search history.

(56) References Cited

U.S. PATENT DOCUMENTS

| | | | |
|---|---|---|---|
| 1,793,006 A | 2/1931 | O'Neill | |
| 2,235,966 A | 3/1941 | Summers | |
| 2,470,026 A | 5/1949 | Freund | |
| 3,388,406 A | 6/1968 | Scrivener | |
| 3,612,509 A | 10/1971 | Boston et al. | |
| 3,810,263 A | 5/1974 | Taylor et al. | |
| 3,967,328 A | 7/1976 | Cox | |
| 4,258,445 A | 3/1981 | Zur | |
| 4,700,415 A | 10/1987 | DiMatteo | |
| 4,726,082 A | 2/1988 | DiMatteo et al. | |
| 4,787,104 A | 11/1988 | Grantham | |
| 4,819,283 A | 4/1989 | DiMatteo et al. | |
| 4,821,348 A | 4/1989 | Pauna | |
| 4,926,513 A | 5/1990 | Oats | |
| 5,020,171 A | 6/1991 | DiMatteo et al. | |
| 5,127,113 A * | 7/1992 | Di Matteo | A61G 7/005 5/612 |
| 5,157,800 A | 10/1992 | Borders | |
| 5,390,379 A | 2/1995 | Palmer, Jr. et al. | |

(Continued)

OTHER PUBLICATIONS

U.S. Appl. No. 15/791,598, filed Oct. 24, 2017, Phillips.

(Continued)

*Primary Examiner* — Christine Skubinna
(74) *Attorney, Agent, or Firm* — Mitch Harris, Atty at Law, LLC; Andrew M. Harris

(57) ABSTRACT

A movable sanitary station for use with a hospital bed includes a cabinet with a front side, a back side, a right side, a left side, a bottom and a top. The back side of the cabinet has a concave shape forming a semi-cylindrical cavity having an axis extending laterally along the back side of the cabinet, permitting a mattress of the bed to protrude forward into the semi-cylindrical cavity. The top extends over the mattress of the bed to cover a gap between a foot of the mattress and the back side of the cabinet. The movable sanitary station also includes a set of wheels for supporting and moving the cabinet and a toilet seat integrated in a central portion of the top of the cabinet and surrounding a first aperture formed through the top of the cabinet.

23 Claims, 19 Drawing Sheets

(56) References Cited

U.S. PATENT DOCUMENTS

| | | | | |
|---|---|---|---|---|
| 5,469,588 | A | 11/1995 | DiMatteo et al. | |
| 5,513,406 | A | 5/1996 | Foster et al. | |
| 5,577,279 | A | 11/1996 | Foster et al. | |
| 5,596,775 | A | 1/1997 | DiMatteo et al. | |
| 5,680,661 | A | 10/1997 | Foster et al. | |
| 5,685,034 | A | 11/1997 | Kleer et al. | |
| 5,781,943 | A | 7/1998 | Moenning et al. | |
| 5,806,114 | A | 9/1998 | Morgan et al. | |
| 5,850,642 | A | 12/1998 | Foster | |
| 6,058,533 | A | 5/2000 | Nelson | |
| 6,112,345 | A | 9/2000 | Foster et al. | |
| 6,363,555 | B1 | 4/2002 | LaRose | |
| 6,374,436 | B1 * | 4/2002 | Foster | A61G 7/0015 5/624 |
| 6,499,156 | B1 | 12/2002 | Dirst | |
| 6,594,837 | B2 | 7/2003 | Khait | |
| 6,611,974 | B2 | 9/2003 | Roit et al. | |
| 6,772,456 | B2 | 8/2004 | Votel | |
| 7,111,338 | B2 | 9/2006 | Faux et al. | |
| 7,337,478 | B1 | 3/2008 | Lake | |
| 7,540,043 | B2 | 6/2009 | Stackley et al. | |
| 7,742,562 | B2 | 6/2010 | Weber | |
| 8,336,134 | B2 | 12/2012 | Jelinek | |
| 8,336,138 | B2 | 12/2012 | Newkirk et al. | |
| 8,453,276 | B2 | 6/2013 | Hillenbrand, II | |
| 8,683,626 | B1 | 4/2014 | Kaczmarek | |
| 8,690,178 | B2 | 4/2014 | Griswold et al. | |
| 8,745,779 | B2 | 6/2014 | Roberg | |
| 9,114,050 | B2 | 8/2015 | White et al. | |
| 9,149,401 | B2 | 10/2015 | Davenport et al. | |
| 9,393,168 | B2 | 7/2016 | Konda | |
| 9,427,367 | B2 | 8/2016 | White et al. | |
| 2005/0086734 | A1 * | 4/2005 | Thies | A45D 19/04 4/516 |
| 2005/0283914 | A1 * | 12/2005 | Roussy | A61G 7/015 5/616 |
| 2006/0037130 | A1 * | 2/2006 | Graham | A47K 11/04 4/480 |
| 2014/0331406 | A1 | 11/2014 | Haider et al. | |
| 2014/0357981 | A1 | 12/2014 | Dumoulin | |

OTHER PUBLICATIONS

Office Action in U.S. Appl. No. 15/791,598 dated Jan. 19, 2018, 16 pages (pp. 1-16 in pdf).

Notice of Allowance in U.S. Appl. No. 15/791,598 dated Mar. 9, 2018, 7 pages (pp. 1-7 in pdf).

Office Action in U.S. Appl. No. 15/936,618 dated Sep. 11, 2018, 24 pages (pp. 1-24 in pdf).

* cited by examiner

MOVABLE SANITARY STATION FOR USE WITH HOSPITAL BED AND METHOD FOR PROVIDING PATIENT SANITATION

BACKGROUND OF THE INVENTION

1. Field of the Invention

The present invention relates generally to medical equipment, and more particularly, to a detachable sanitary station for use with a hospital bed.

2. Description of the Related Art

Hospitals and other care facilities, in some cases including a disabled person's home, have a need for handling patients and persons with disabilities who may not have the ability to leave their bed, or who may have difficulty doing so. In particular, patient transfer is needed for permitting a patient to use a toilet and for subsequent cleaning needs. Hospital beds are available that can transfer a patient to the end of the bed and/or move a patient to different positions and such beds may also include removable panels for accessing a bedpan or other type of toilet seat. However, existing designs pose problems both with the movement of the mattress atop the bed, and with efficient handling of the toilet apparatus.

Therefore, it would be desirable to provide a hospital bed and hospital bed system having improved handling of the mattress during transport of a patient and efficient handling of cleaning and sanitary needs.

SUMMARY OF THE INVENTION

Efficient handling of patients and other disabled persons, including handling for cleaning and sanitary needs is provided in a movable sanitation station, as well as a method of providing patient sanitation.

The movable sanitary station includes a cabinet having a front side, a back side, a right side, a left side, a bottom and a top. The back side of the cabinet has a concave shape forming a semi-cylindrical cavity having an axis extending laterally along the back of the cabinet for permitting the convex top a mattress of the bed to protrude forward into the semi-cylindrical cavity when the mattress is rolled around a roller having an axis of rotation disposed beneath the portion of the mattress that lies atop the bed. The semi-cylindrical cavity has a maximum extension toward the front of the cabinet and is located at a height that corresponds to the rotational axis of the roller. The top extends over the mattress of the bed to cover a gap between a foot of the mattress and the back side of the cabinet, so that the top of the cabinet and a top of the mattress are aligned to permit a patient lying supine on the bed to be transported from the top of the mattress to the top of the cabinet without lifting or dropping the patient in elevation. The movable sanitary station also includes a set of wheels for supporting and moving the cabinet and a toilet seat integrated in a central portion of the top of the cabinet and surrounding a first aperture formed through the top of the cabinet.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present disclosure shows devices and methods that move and support hospital patients to provide sanitary services at a hospital bed. The hospital bed provides a moving mattress that is flexible to bend under the foot of the bed and into a chute while moving the patient, and the sanitary station locks to the hospital bed while providing a toilet seat and cleaning facilities when the patient has been moved by the mattress to a position atop the toilet seat.

Figure 1:
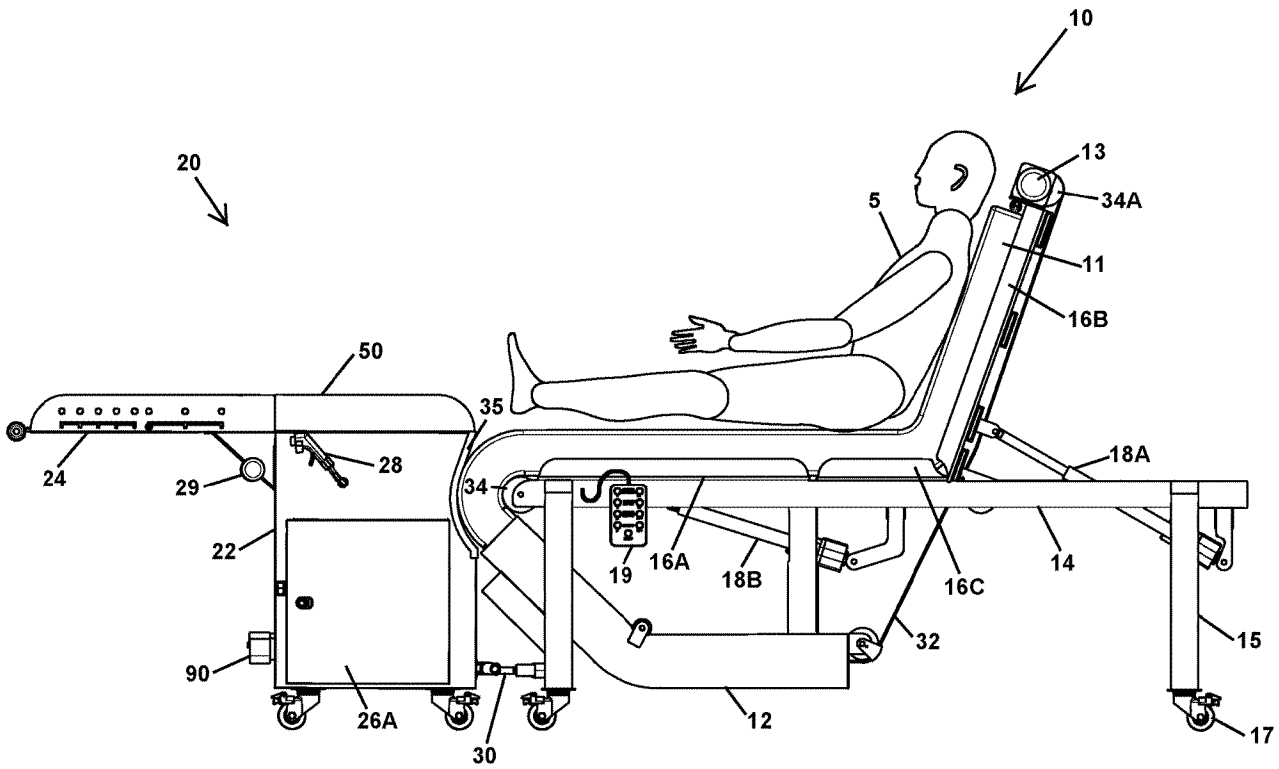
FIGS. 1-7 are side views showing an example of a sanitary station 20 and a hospital bed 10 performing a method as disclosed herein for moving and providing sanitation to a patient 5.

Referring now to FIG. 1, an exemplary sanitary station 20 is shown in a side view linked to an example hospital bed 10. FIGS. 1-7 demonstrate a method according to the disclosure for moving and providing sanitation to a patient 5. In FIG. 1, patient 5 is in a seated position, provided by activating a linear motor 18A to raise a pallet segment 16B until the desired angle of recline is reached. A mattress 11 supports patient 5 above a pallet provided by three pallet segments 16A-16C that hold mattress 11 above a frame 14 having legs 15 that extend downward to a set of rollers 17 that provide for moving hospital bed 10. Sanitary station 20 is linked to hospital bed 10 with a locking mechanism 30 that draws sanitary station 20 toward hospital bed 10 until mattress 11 protrudes into a curved recess 35 provided on the back of a cabinet 22 that supports a top 50 that includes a toilet seat (not shown). Top 50 is then positioned to extend over hospital bed 10, so that there is no vertical gap between hospital bed 10 and sanitary station 20. Sanitary station 20 also includes a water sprayer 28 for cleaning patient 5, a cabinet door 26A for accessing internals of sanitary station 20, a battery pack 90 for supplying power to sanitary station 20, as well as a pair of leg chutes 24 that guide and support the legs of patient 5 when patient 5 is moved over sanitary station 20. A locking bar 29 provides for raising and lowering leg chutes 24, so that the legs of patient 5 can be supported in a horizontal position or lowered to a vertical position. Mattress 11 is composed of a flexible foam pad that bends around a roller 34 having an axis of rotation disposed beneath a bottom of mattress 11 atop hospital bed 10 and extends into a chute 12 having a rectangular cross-section slightly larger than that of mattress 11. The height of the maximum extension of mattress 11 toward cabinet 22 when mattress 11 is bent around roller 34 corresponds to the height of the maximum extension of the curved recess 35 toward the front of cabinet 22 so that cabinet 22 is fitted to the convex top portion of mattress 11 around roller 34. A belt 32 having a width of approximately 2" to 4" is attached at the ends thereof to the head and foot of mattress 11 and returns through chute 12 to provide a complete loop along with mattress 11. Belt 32 is driven by a motor 13 that turns another roller 34A to move mattress 11 along pallet segments 16A-16C and into chute 12 to move patient 5 toward the foot of hospital bed 10 and onto sanitary station 20. A control pod 19 operates motor 13 as well as linear motor 18A and another linear motor 18B that is used to raise and lower pallet segment 16A in subsequent operations described below.

Figure 2:
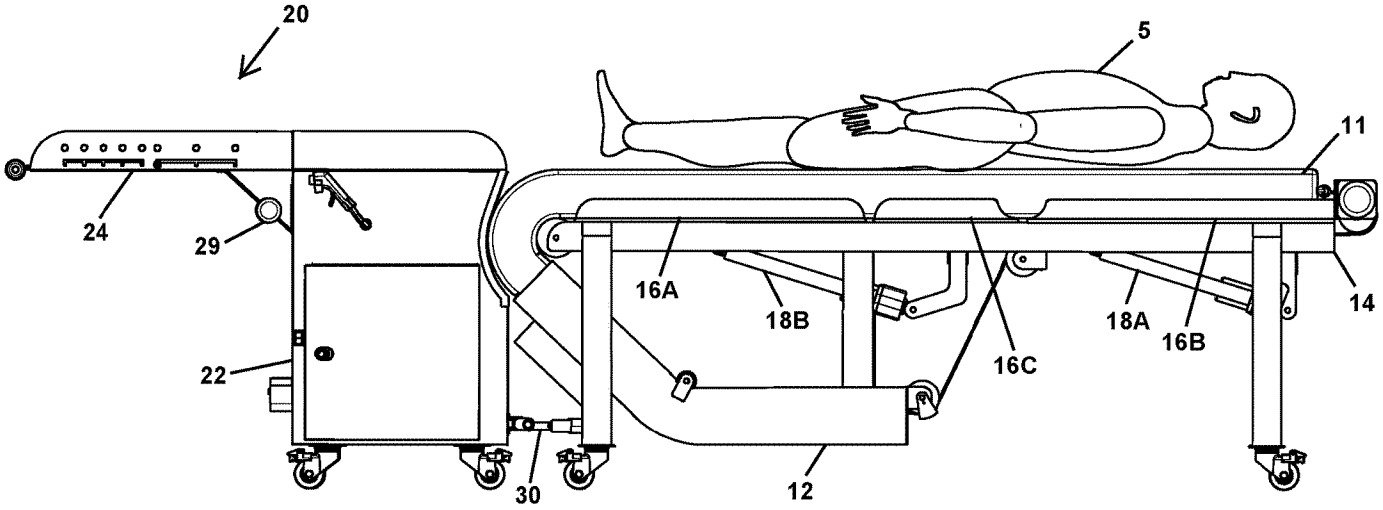
Figure 3:
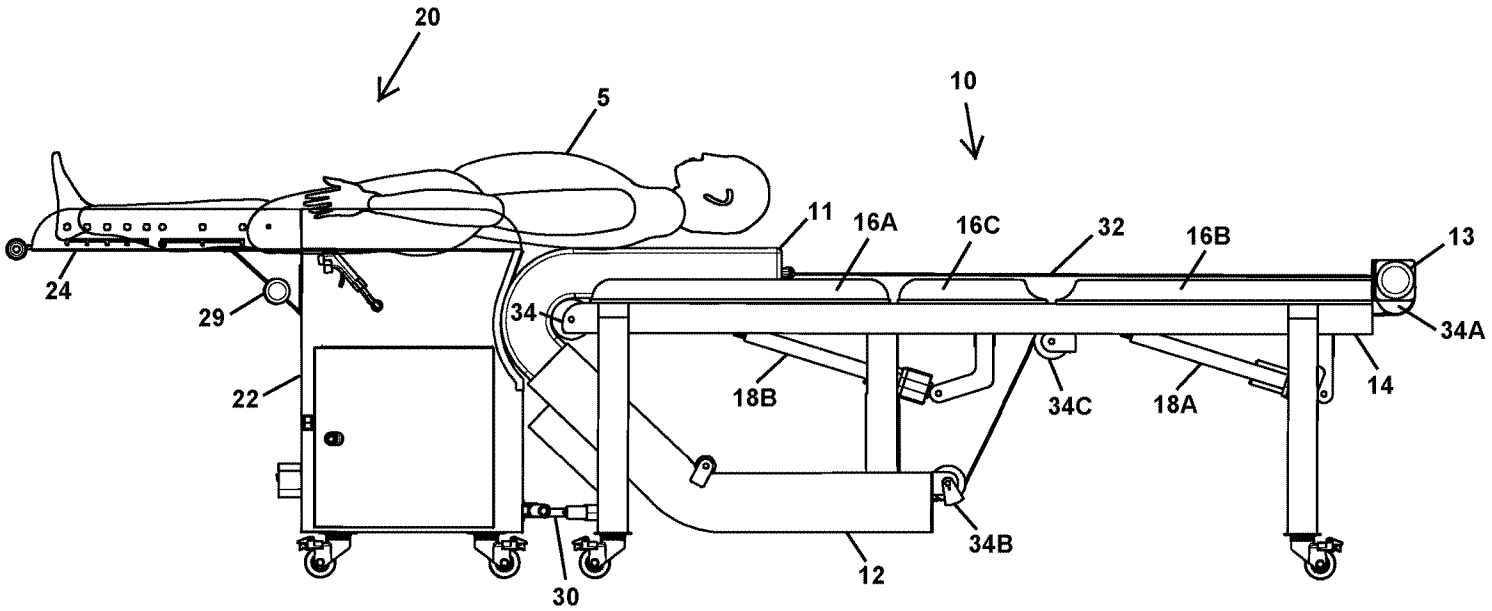
Figure 4:
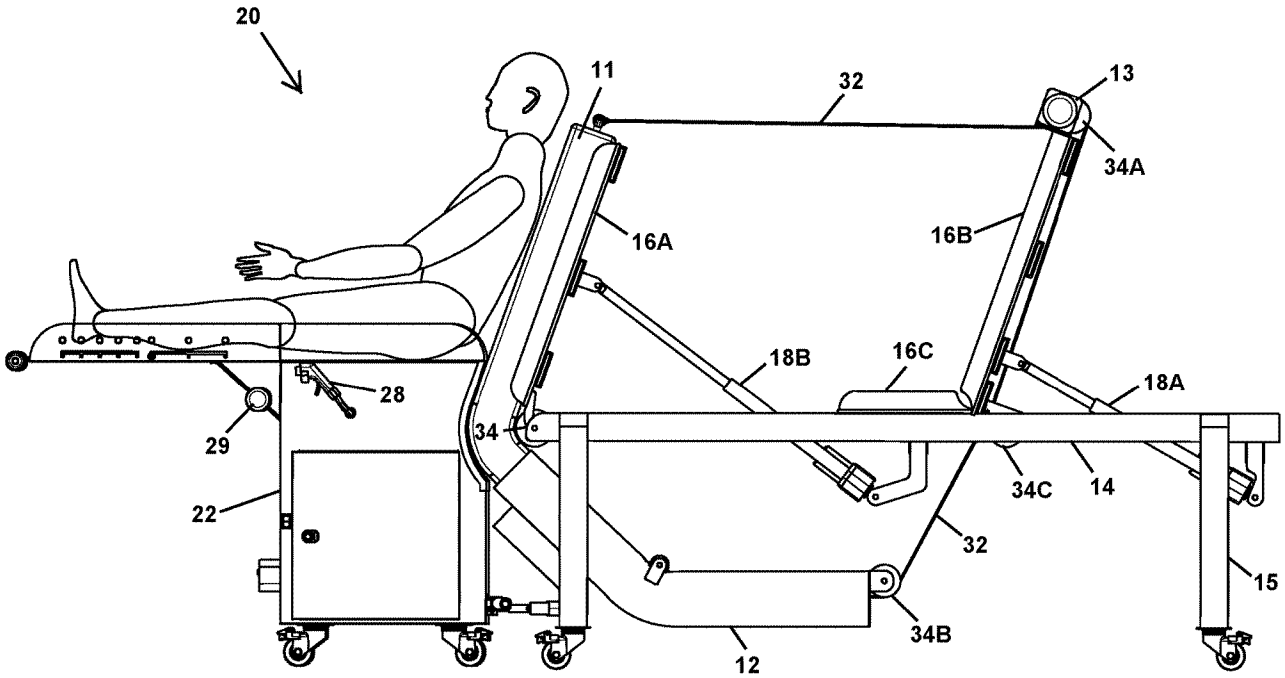
Figure 5:
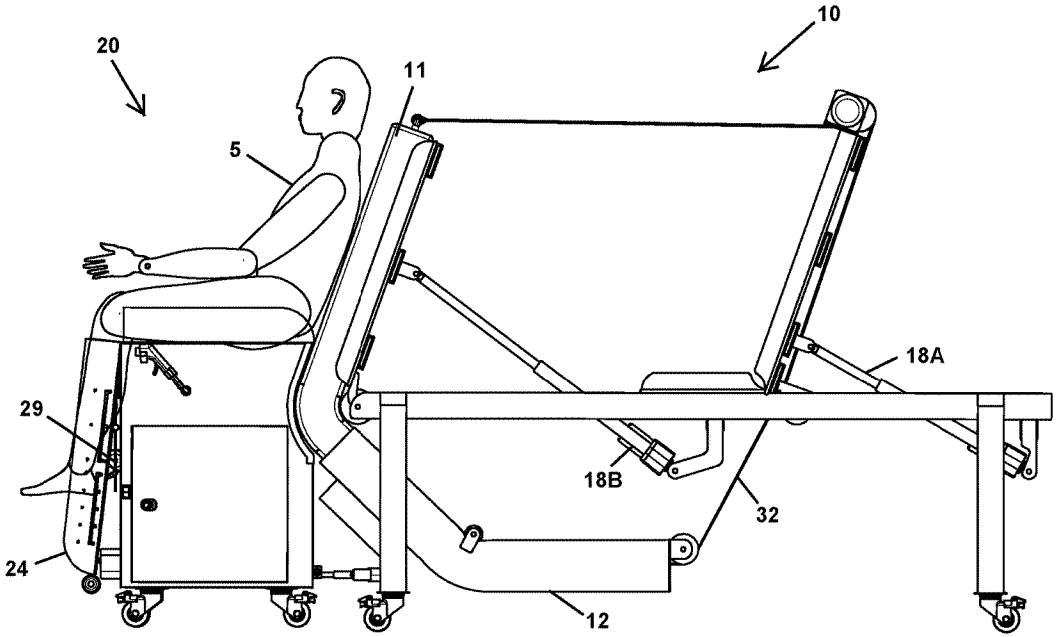
Figure 6:
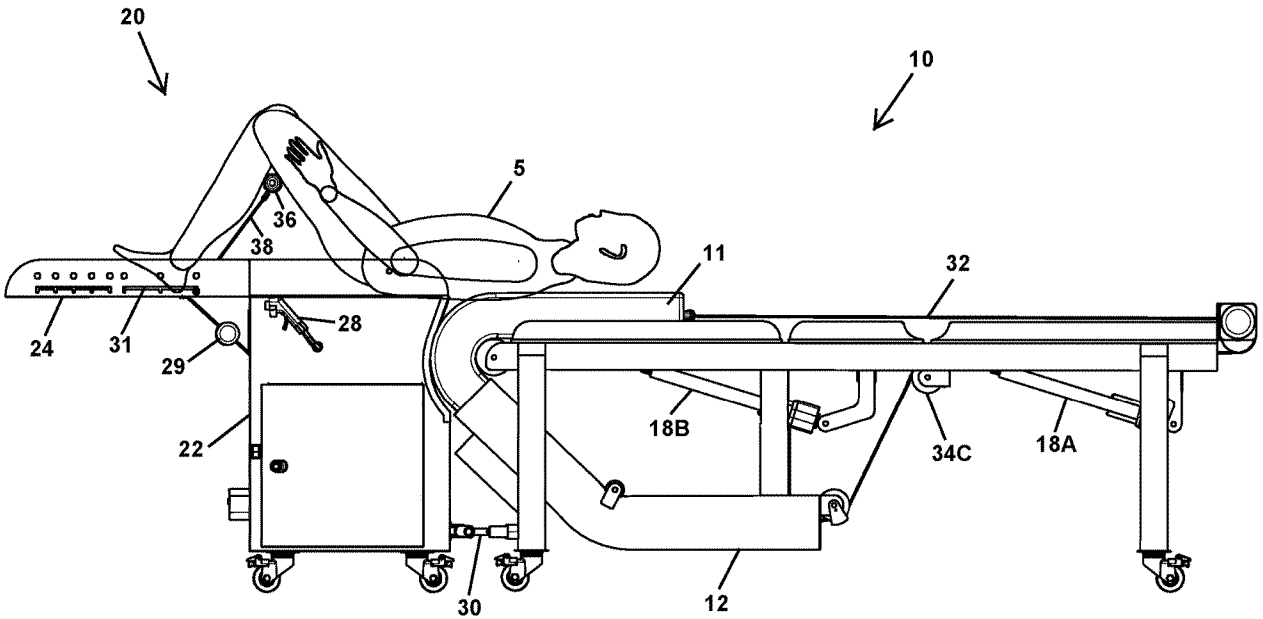
Figure 7:
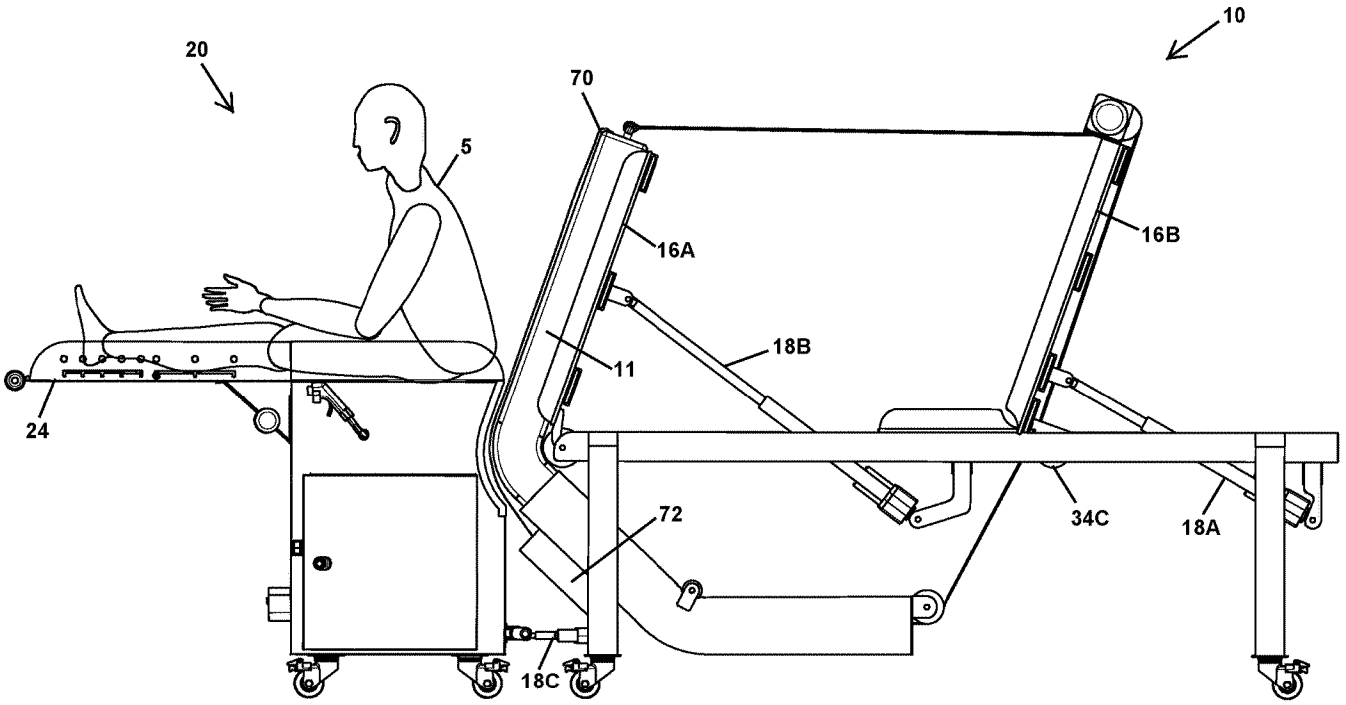

Referring now to FIGS. 2-7, a method of moving patient 5 onto and off of sanitary station 20 is shown. In FIG. 2, patient 5 is lowered to a supine position by activating linear motor 18A to lower pallet segment 16B. In FIG. 3, motor 13 is activated to rotate roller 34A which drives belt 32 to pull mattress 11 further into chute 12 and to move the head of mattress 11 off of pallet segments 16B and 16C and onto pallet segment 16A. Leg chutes 24 are locked in the horizontal position by locking bar 29 and guide the legs of patient 5, as patient 5 is moved atop sanitary station 20. In FIG. 4, pallet segment 16A is raised to support the back of patient 5 to return patient 5 to a seated position atop sanitary station 20 by activating linear motor 18B. The control of linear motor 18B and linear motor 18A is linked so that pallet segment 16B is raised in concert with pallet segment 16A, maintaining the length of the loop formed by mattress 11 and belt 32 so that additional slack and take-up mechanisms are not needed to provide relief when the head of mattress 11 is raised above frame 14. Some level of tensioning and relief is provided by a tensioning roller 34C that maintains belt 32 at a substantially constant tension as belt 32 is moved along roller 34A by motor 13 and another roller 34B located at the exit of chute 12. Pallet segment 16C is a fixed segment and may be used to provide rigidity to frame 14. In FIG. 5, leg chutes 24 are lowered by releasing locking bar 29 to permit patient 5 to sit atop the toilet seat (not shown) integrated in the top of sanitary station 20. In FIG. 6, leg chutes 24 are again locked in a horizontal position by locking bar 29, so that patient 5 can be cleaned. A set of knee supports 38 terminating in rollers 36 are moved under the backs of the knees of patient 5 by rolling rollers 36 along the undersides of the legs of patient 5 until the proper position is reached. A set of slots 31 is provided on each side of each of leg chutes 24 for adjustment of the position of knee supports 38. Sprayer 28 can then be pulled out to assist in cleaning patient 5. In FIG. 7, patient 5 has been lifted up by activating linear motor 18B to raise pallet segment 16A and has further leaned forward so that sanitary station 20 and hospital bed 10 can be separated by a few inches. A linear motor 18C forming part of locking mechanism 30 is activated to extend sanitary station 20 from the end of mattress 11, allowing replacement of bedding, such as an existing disposable sheet and/or bed pad. A disposable sheet 70 is extracted from a sheet holder 72 located beneath chute 12 and pulled upward to fasten disposable sheet 70 at the head of mattress 11, such as by providing hook-and-loop fasteners on disposable sheet 70 and at the head of mattress 11. Moving patient 5 back to a resting position is performed by drawing sanitary station 20 back to join hospital bed 10 by activating linear motor 18C, and then repeating the steps shown in FIGS. 2-5 or FIGS. 1-5 in reverse order.

Figure 8:
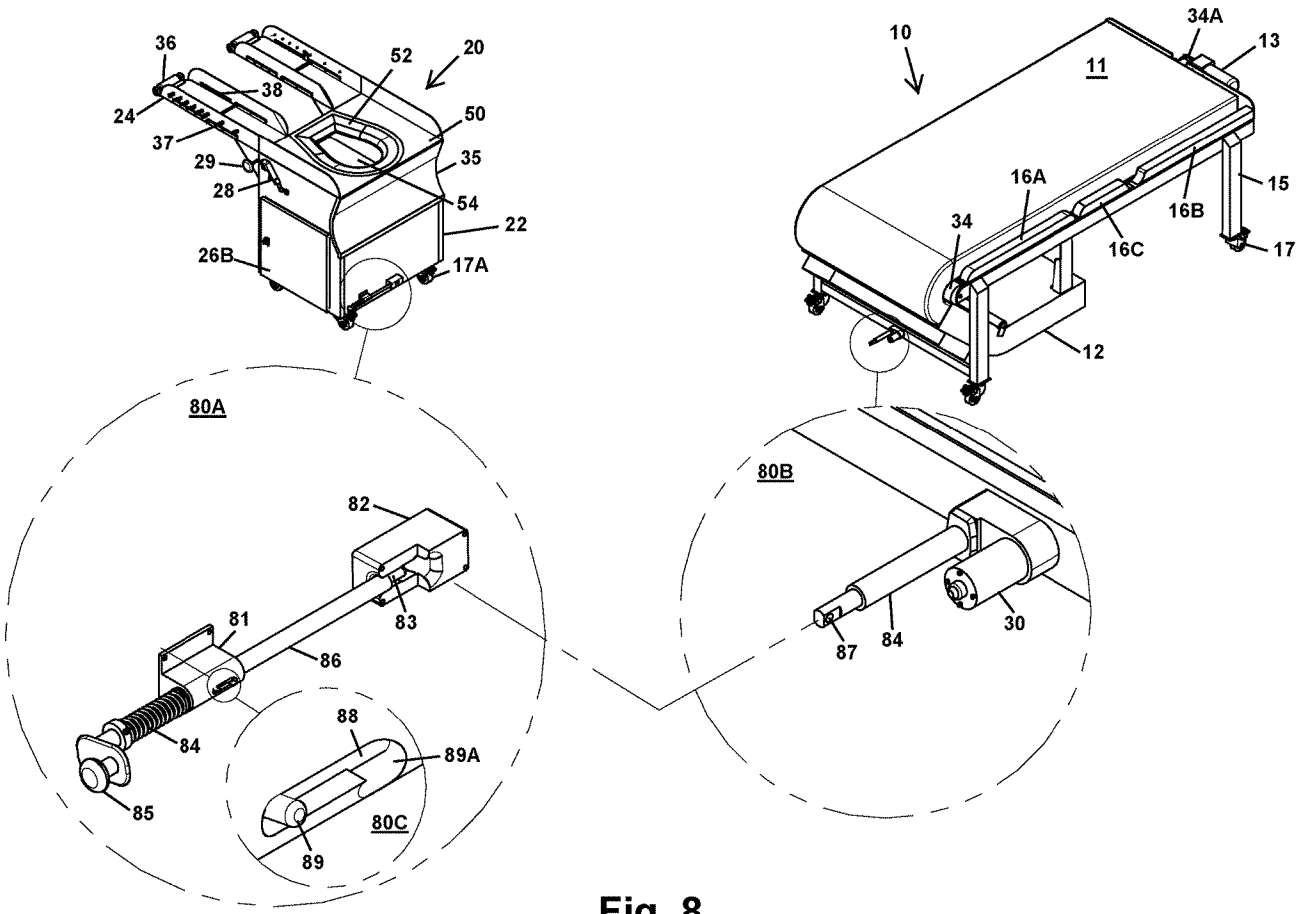
FIG. 8 is a perspective view showing details of an interconnect between sanitary station 20 and hospital bed 10 of FIGS. 1-7.

Referring now to FIG. 8, a perspective view showing details of an example interconnect between sanitary station 20 and hospital bed 10 of FIGS. 1-7 is shown. Detail callout 80A shows the portion of locking mechanism 30 in FIG. 1 that is installed on sanitary station 20, which comprises a rod 86 that is guided by a mount 81 and terminates in a locking pin 83 at a first end and a knob 85 at a second end. The first end of rod 86 enters a guiding port 82 that accepts an end 87 of a counterpart of locking mechanism 30 mounted on hospital bed 10 as shown in detail callout 80B, and that extends from a linear motor 84 that is activated in one direction or the other to draw sanitary station 20 and hospital bed 10 together or apart. Detail callout 80C shows a pin 89 that travels along a slot 89 that is shaped to include a recess 89A in which pin 89 can be secured by turning knob 85 to lock sanitary station 20 and hospital bed 10 together, by holding locking pin 83 within a corresponding hole at the end 87 of linear motor 84.

FIG. 8 also shows further details of sanitary station 20, which is movably supported on a set of rollers 17A. The shape of curved recess 35 can be seen and forms a semi-cylindrical indentation in the back side of cabinet 22. A removable pan 54 lies beneath a toilet seat 52 and top 50 of cabinet 22. Spring-loaded pull pins 37 provide adjustment of the position of knee support 38 and a number of slots are provided in the side wall of leg chute 24, so that the position at which the end of knee support 38 is pinned to forming a hinge connection to leg chute 24 is adjustable, along with the position of knee support 38 between pull pins 37, which adjust the final upward and lateral position of roller 34. An additional set of pull pins and slots are provided toward the foot of leg chute 24 for attaching and adjusting a pair of foot support plates (not shown).

Figure 9B:
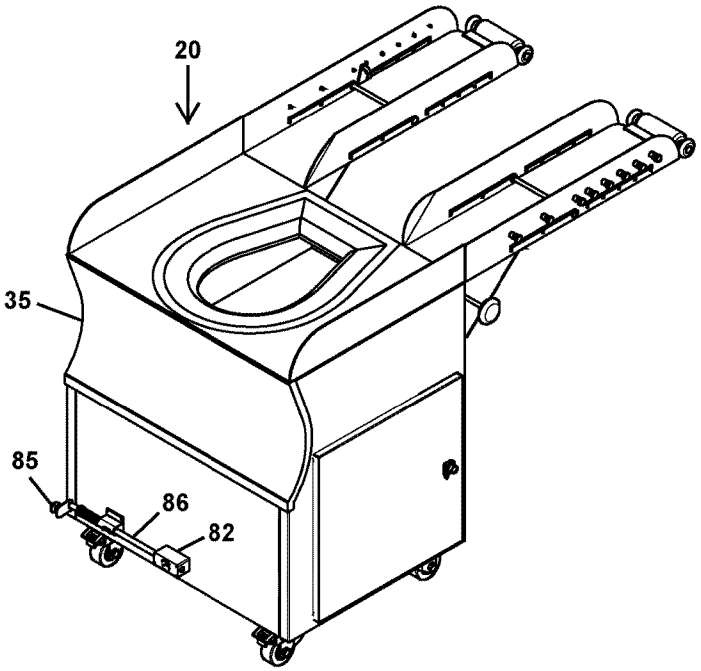
FIG. 9A and FIG. 9B are back right and front left perspective views, respectively, of sanitary station 20 of FIGS. 1-7
Figure 9A:
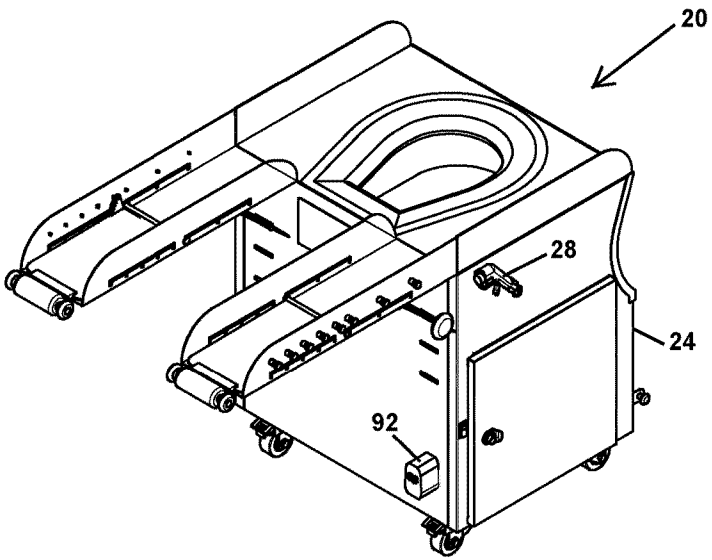
Figure 9C:
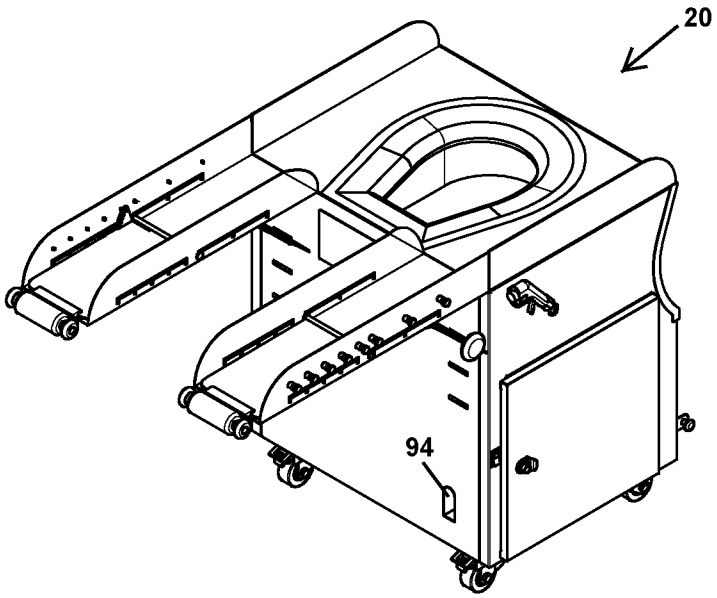
FIG. 9C is a back right perspective view of sanitary station 20 with a battery pack 92 removed.

Referring now to FIGS. 9A-9C perspective views of sanitary station 20 are shown, illustrating further details of sanitary station 20. In FIG. 9A a rechargeable battery pack is shown installed against the back wall of cabinet 22 and FIG. 9C shows a connector 94 that receives battery pack 92 with battery pack 92 removed.

Figure 10:
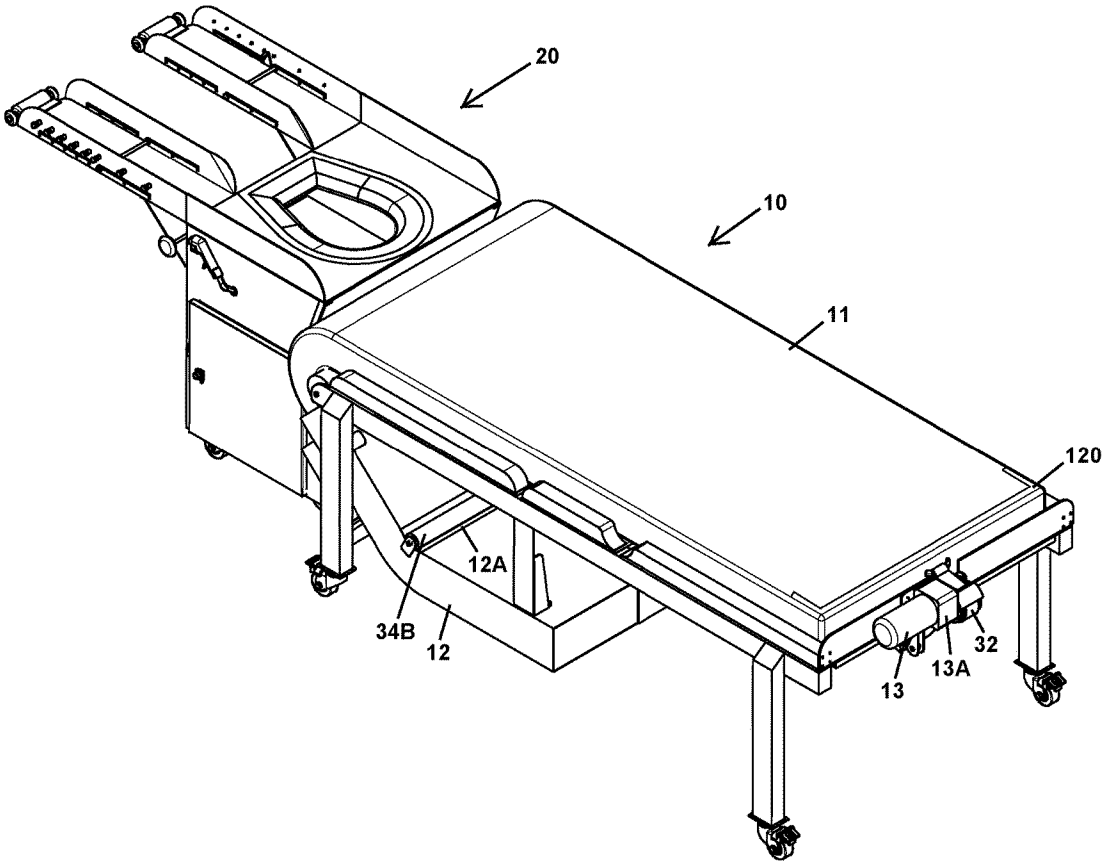
FIG. 10 and FIG. 11 are a back left perspective view and a left side view, respectively, of sanitary station 20 and hospital bed 10 locked together.
Figure 11:
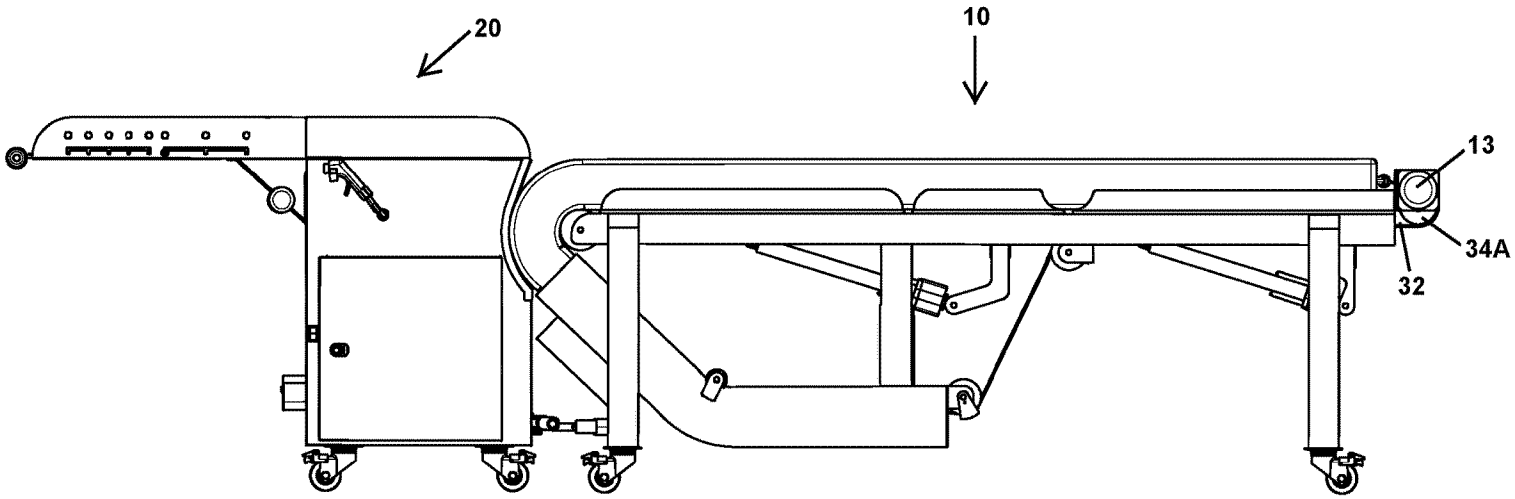

Referring now to FIG. 10 and FIG. 11 a back left perspective view and a left side view, respectively, of sanitary station 20 and hospital bed 10 locked together show further details of hospital bed 10. At each end of mattress 11, a plastic frame 120 is provided that is used to stabilize the ends of mattress 11 so that tension can be applied from belt 32 across the end of mattress 11 without distortion. One or more metal rods or other reinforcement may be embedded within or behind plastic frame 120 to provide a linkage to which belt 32 is connected within the end of mattress 11. Plastic frame 120 may be, for example, a ¾" plate made from polyvinyl acetate or other suitable acrylic having sufficient stiffness and having a profile matching a thickness and width of mattress 11. Motor 13 includes a gearbox 13A that provides for reducing the rotation rate provided by motor 13 and increasing the torque applied to belt 32. Belt 32 may include a gearing pattern formed on a portion of the length of belt 32 expected to travel along roller 34 and roller 34A may include a complementary tooth pattern, to eliminate slip between belt 32 and roller 34A. Roller 34B extends through a slot 12A provided in chute 12 to permit roller 34B to contact portions of mattress 11 that extend within chute 12 to roller 34B and to contact belt 32 when mattress 11 does not extend into chute 12 or when the portion of mattress 11 within chute does not extend to roller 34B.

Figure 12B:
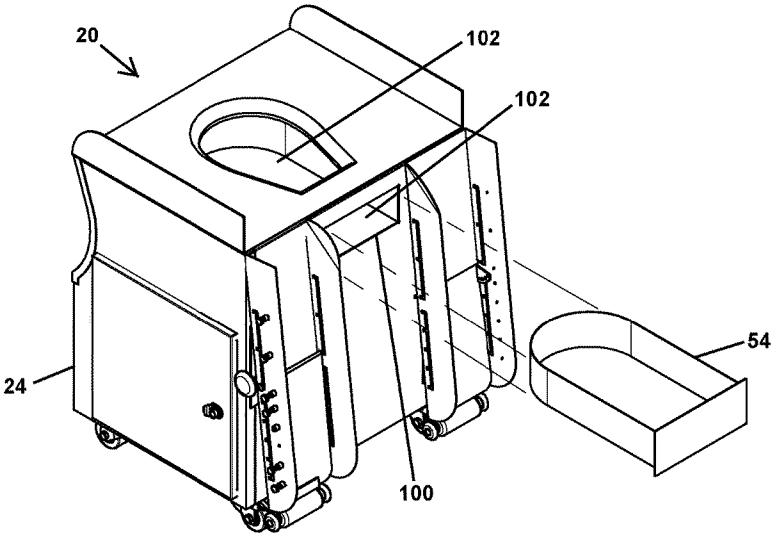
FIG. 12A and FIG. 12B are back left perspective views of sanitary station 20.
Figure 12A:
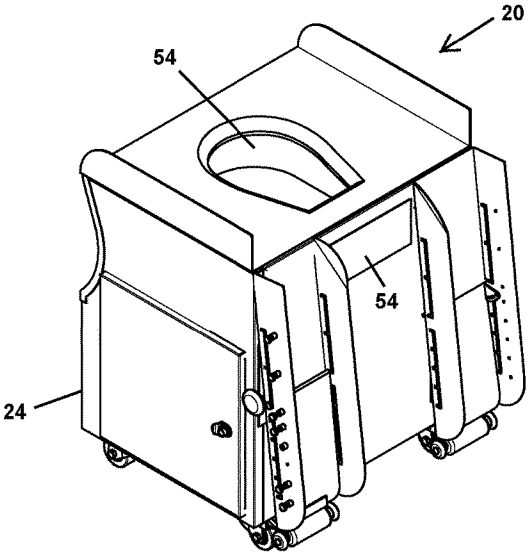

FIG. 12A and FIG. 12B are back left perspective views of sanitary station 20 showing the operation of removable pan 54 that is slid through a corresponding aperture 100 within cabinet 22. In FIG. 12A, removable pan 54 is installed in a sealed recess 102 within cabinet 22 and in FIG. 12B, removable pan 54 is installed within sealed recess 102.

Figure 12D:
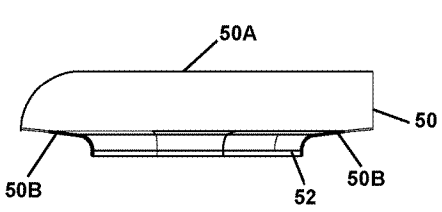
FIGS. 12C-12F are cross-section views of a top 50 of sanitary station 20.
Figure 12F:
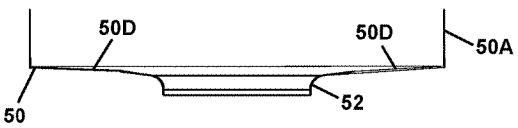
Figure 12C:
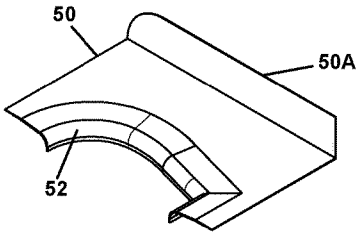
Figure 12E:
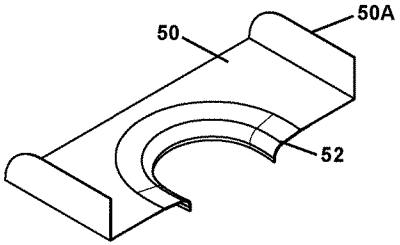

Referring now to FIGS. 12C-12F, cross-section views of top 50 of sanitary station 20 are shown. FIG. 12C shows a perspective view of a front-to-back cross-section of top 50 and toilet seat 52, showing sides 50A and FIG. 12D is a side cross section view showing inclined portions 50B of top 50 extending downward with approximately a 20-25% slope to the curvature of toilet seat 52, which in the example is formed within top 50 e.g., out of stamped/bent stainless steel. FIG. 12E shows a perspective view of a side-to-side cross-section of top 50 and toilet seat 52, showing sides 50A and FIG. 12F is a front cross section view showing inclined portions 50D of top 50 extending downward with approximately a 10-15% slope to the curvature of toilet seat 52. The sloped top 50 of sanitary station 20 ensures fluid waste will travel to toilet seat 52 and into removable pan 54 and also ensures that water used for cleaning will also end up in removable pan 54.

Figure 13:
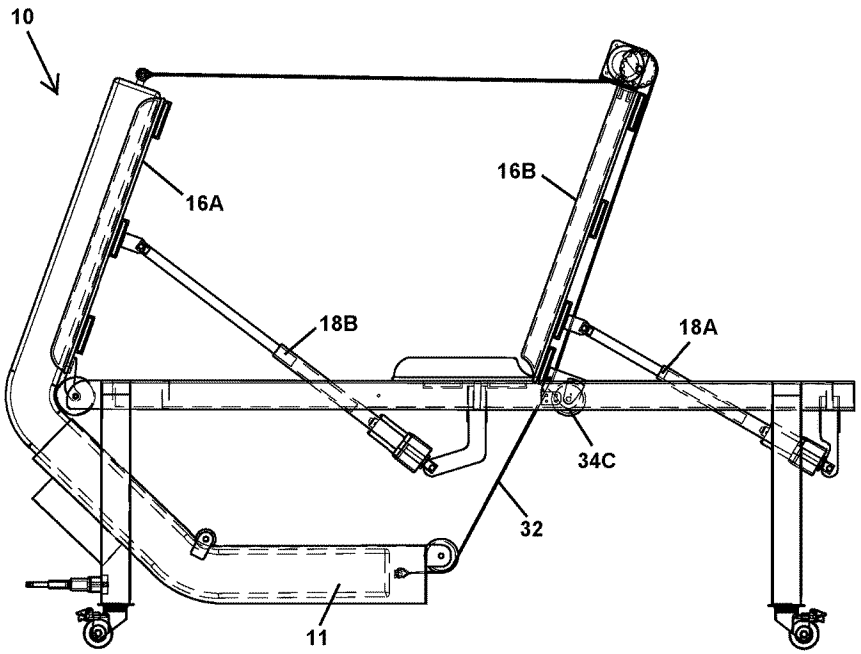
FIG. 13 is a side view of hospital bed 10 in a configuration for supporting a patient atop an attached sanitary station 20 or for lifting a patient to a standing position.
Figure 14:
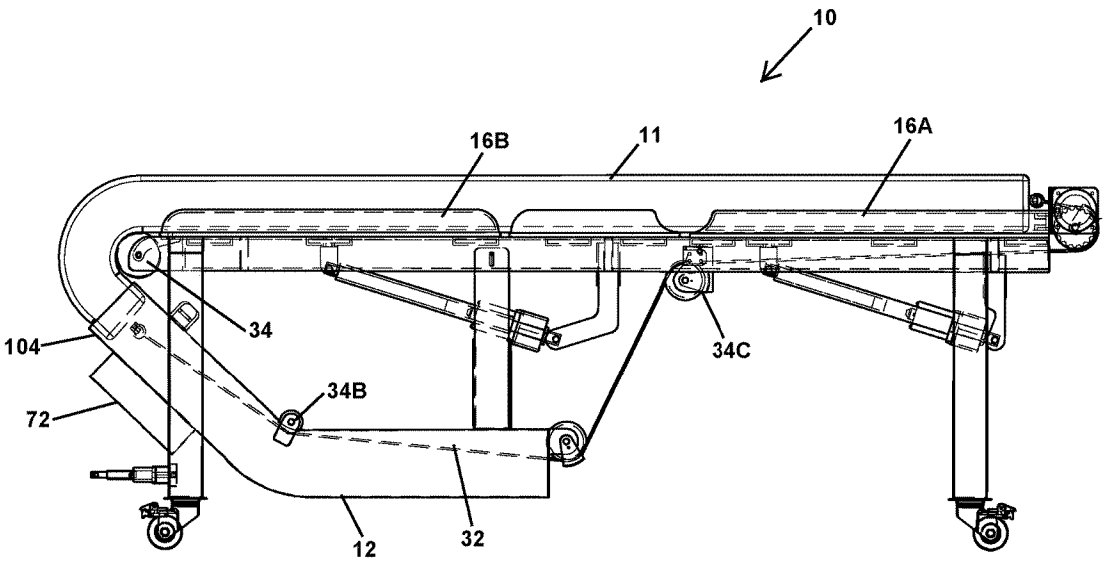
FIG. 14 is a side view of hospital bed 10 in a configuration for supporting a patient in a supine resting position.

Referring now to FIG. 13 and FIG. 14, side views of hospital bed 10 shows further details of hospital bed 10. FIG. 13 shows hospital bed 10 in a configuration for supporting a patient atop an attached sanitary station or for lifting a patient to a standing position. Mattress 11 is drawn by belt 32 to substantially the full extent of chute 12 and details of tension roller 34C, which is generally a spring-loaded adjustable tensioner are visible. Tension roller 34C is relaxed and not in contact with belt 32 in the depicted position of pallet segment 16B and linear motor 18A, as mattress 11 is not moved while either of pallet segments 16A and 16B are raised. FIG. 14 shows hospital bed 10 in a configuration for supporting patient 5 lying on hospital bed 10. Mattress 11 is in the other extreme of position with respect to FIG. 13, since the head of mattress 11 is substantially at the head of hospital bed 10. Tension roller 34C is engaged and mattress 11 extends only slightly into chute 12, so that the complete bend around roller 34 is provided and belt 32 extends through chute 12 and contacts roller 34B. Belt 32 does not ever exit the end of chute 12 through which mattress 11 extends, so that the thickness and width of mattress 11 remain properly positioned with respect to an entrance 104 of chute 12. The position of sheet holder 72 can also be seen in further detail as mounted on the bottom side of chute 12 near entrance 104.

Figure 15:
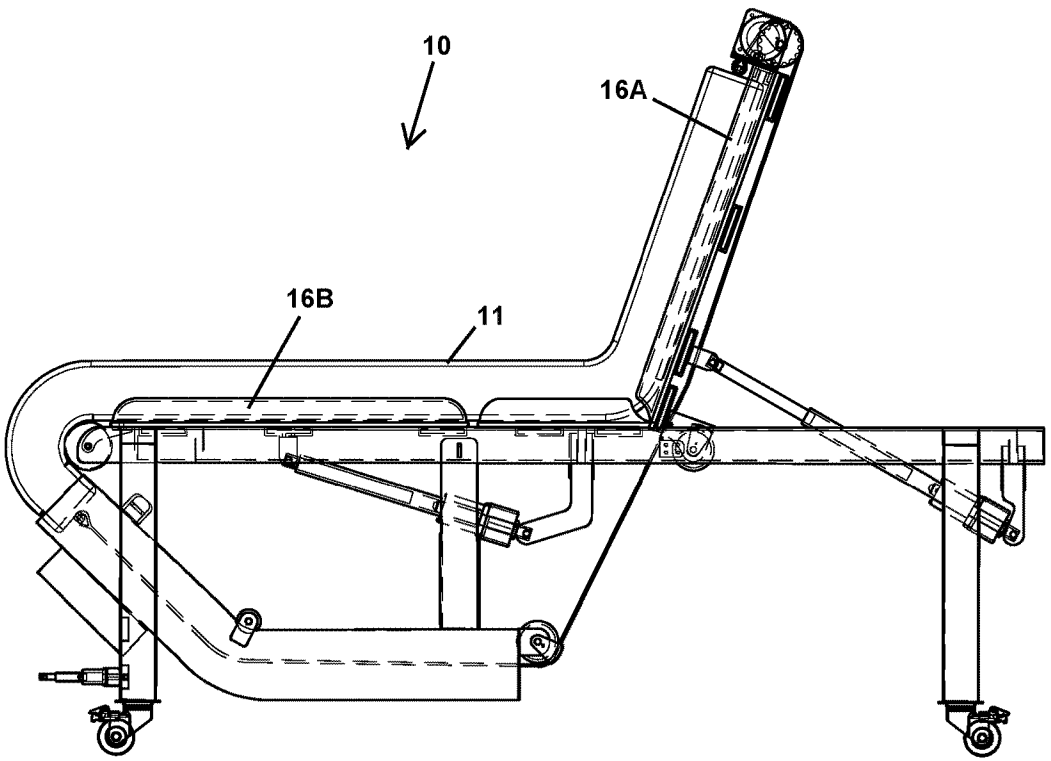
FIG. 15 is a side view of hospital bed 10 in a configuration for supporting a patient in a seated position in hospital bed 10.

FIG. 15 is a side view showing details of hospital bed 10 in a configuration for supporting a patient in a seated position in hospital bed 10. The position of mattress 11 with respect to chute 12 and pallet segments 16A,16B is identical to that of FIG. 14. Tension roller 34C is disengaged and mattress 11 will not be moved in the depicted configuration with pallet segment 16A raised and linear motor 18B extended.

Figure 16:
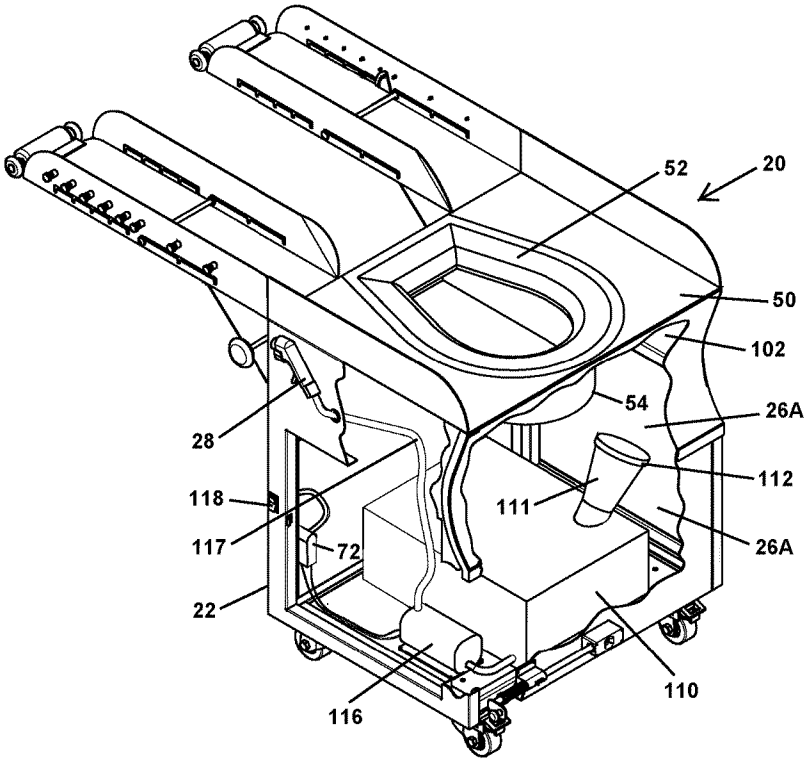
FIG. 16 is a perspective view of sanitary station 20, showing internal details thereof.

FIG. 16 is a perspective view of sanitary station 20, showing internal details thereof. Sealed recess 102 has been opened to show the bottom of removable pan 54. A water tank 110 is fillable via a funnel 111 spout, shown with a removable cap 112 installed. Water tank 110 supplies water to a pump 116, which, when activated, supplies pressurized water to sprayer 28 through a hose 117 that retracts into cabinet 22 when sprayer 28 is not in use. Battery pack 92 is visible and is coupled in series with a switch 118 and pump 116 to activate the supply of water to sprayer 28.

Figure 17:
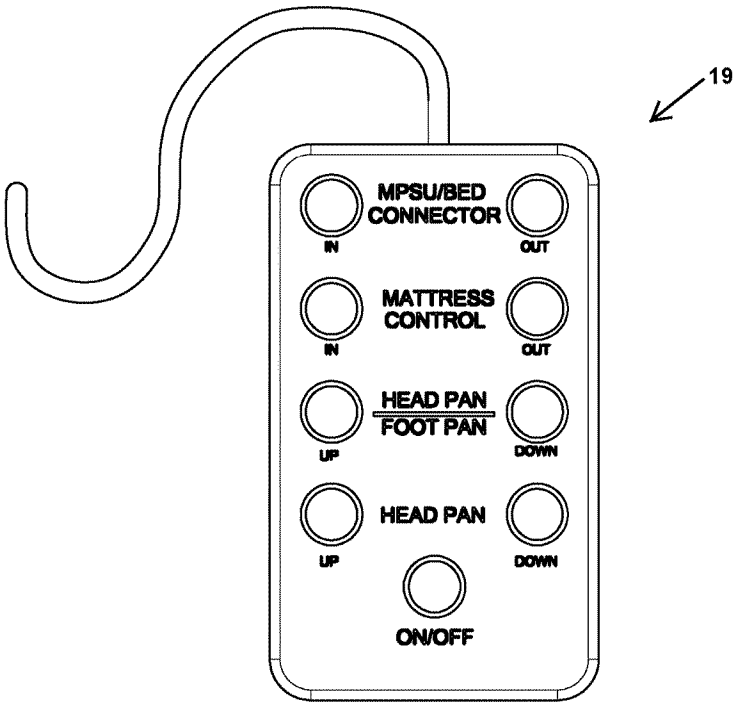
FIG. 17 is a front view showing details of a control pod 19 of FIG. 1.

FIG. 17 is a front view showing details of control pod 19 of FIG. 1. While pump 116 described above is operated by a battery 90 inserted in battery pack 92, power to motor 13 is provided separately and is generally supplied from either isolated AC mains or an isolated DC power supply. Similarly, linear motors 18A-18C can be DC operated, or operated from isolated AC mains. Control pod 19 may operate relays located at motor 13 and at linear motors 18A-18C, or may provide switches directly controlling current supplied to motor 13 and linear motors 18A-18C. The left set of buttons supply a first polarity/phase to corresponding ones of motor 13 and linear motors 18A-18C and the right buttons supply a second polarity/phase to the corresponding motor (s), so that directions of "in" vs. "out" and "up" vs. "down" are controlled by control pod 19. The first row of switches labeled MPSU/Bed connector operates linear motor 18C to move sanitary unit 20 and hospital bed 10 together (in) or apart (out), i.e., to transition between the positions of hospital bed 10 and sanitary station 20 shown in FIGS. 6 and 7. The next row of switches labeled mattress control operates motor 13 to move mattress 11 into or out of chute 12, i.e., to transition between the positions of hospital bed 10 shown in FIGS. 2 and 3. The third row of switches labeled "head pan/foot pan" operates linear motors 18A and 18B in concert to raise and lower pallet segments 16A and 16B in parallel, i.e., to transition between the positions of hospital bed 10 shown in FIGS. 3 and 4. The last row of switches labeled "head pan" operates only linear motor 18A to raise and lower pallet segment 16A, i.e., to transition between the positions of hospital bed 10 shown in FIGS. 1 and 2.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A movable sanitary station for use with a hospital bed, comprising:

a cabinet having a front side, a back side, a right side, a left side, a bottom and a top, wherein the back side of the cabinet has a concave shape forming a semi-cylindrical cavity having an axis extending laterally along the back side of the cabinet and at a height such that a maximum extension of the semi-cylindrical cavity toward the front side of the cabinet is located at a height beneath a portion of a mattress that lies atop the hospital bed so that an outer convex top surface of the mattress of the bed that is rolled around a roller having an axis of rotation disposed beneath the portion of the mattress that lies atop the hospital bed protrudes forward into the semi-cylindrical cavity when the hospital bed is secured to the movable sanitary station, while permitting the top to extend over the mattress to cover a gap between the outer convex top surface of the rolled mattress and the back side of the cabinet so that the top of the cabinet and a top of the mattress are aligned to permit a patient lying supine on the bed to be transported from the top of the mattress to the top of the cabinet without lifting or dropping the patient in elevation;

a set of wheels for supporting and moving the cabinet; and a toilet seat integrated in a central portion of the top of the cabinet and surrounding a first aperture formed through the top of the cabinet.

2. The movable sanitary station of claim 1, wherein at least a portion of an exterior surface of the top is sloped inward toward the toilet seat from each of the right side, the left side, the front side and the back side downward toward the toilet seat.

3. The movable sanitary station of claim 2, further comprising a waste drawer that slides into a second aperture formed in one of the left side, the right side or the front side of the cabinet to capture waste that enters the first aperture through the top of the cabinet, and wherein the cabinet further comprises a sealed compartment inside the cabinet that is open only at the first aperture and the second aperture.

4. The movable sanitary station of claim 3, wherein the second aperture is formed on the front side of the cabinet, and wherein the waste drawer slides through the front side of the cabinet to extend beneath the first aperture.

5. The movable sanitary station of claim 1, further comprising:

a water reservoir disposed within the cabinet;

a pump within the cabinet and coupled to the water reservoir for pumping water from the water reservoir; and a hand-operated water sprayer disposed outside of the cabinet and coupled to the pump by a hose that extends into the cabinet.

6. The movable sanitary station of claim 5, further comprising a battery connector disposed on one of the front side, the back side, the right side or the left side of the cabinet for receiving a removable and rechargeable battery pack, wherein the battery connector is coupled to the pump for supplying operating current to the pump.

7. The movable sanitary station of claim 1, further comprising a locking mechanism provided on the back side of the cabinet for connecting the movable sanitary station to the hospital bed.

8. The movable sanitary station of claim 1, further comprising a pair of leg chutes rotatably coupled to the cabinet near the junction of the top and the front side of the cabinet for supporting legs of the patient once the patient has been moved atop the toilet seat, wherein the pair of leg chutes are rotatable between a first position in which the pair of leg chutes extend downward along the front of the cabinet, and a second position in which the pair of leg chutes are locked to extend in line with the top of the cabinet.

9. The movable sanitary station of claim 8, wherein the pair of leg chutes further include a pair of corresponding knee supports coupled to the pair of leg chutes and that extend away from and above the pair of leg chutes and the top of cabinet when the pair of leg chutes are locked in the second position for supporting knees of the patient above the top of the cabinet when the patient has been moved to a cleaning position with a torso of the patient atop the bed and the legs of the patient with bent knees supported above the top of the cabinet by the pair of corresponding knee supports.

10. The movable sanitary station of claim 9, wherein the pair of corresponding knee supports are rotatably coupled to a corresponding one of the pair of leg chutes near a midpoint of the pair of leg chutes, and wherein the pair of corresponding knee supports each terminate in a corresponding one of a pair of rollers at ends of the pair of corresponding knee supports away from the pair of leg chutes, whereby the one of the pair of rollers of the pair of corresponding knee supports can be rolled along a corresponding one of the legs of the patient and locked into position behind the bent knees of the patient once the one of the pair of rollers has reached a back of a knee of the corresponding leg.

11. A movable sanitary station for use with a hospital bed, comprising:

a cabinet having a front side, a back side, a right side, a left side, a bottom and a top, wherein the back side of the cabinet has a concave shape forming a semi-cylindrical cavity having an axis extending laterally along the back side of the cabinet at a height such that a maximum extension of the semi-cylindrical cavity toward the front of the cabinet is located at a height beneath a portion of a mattress that lies atop the hospital bed so that an outer convex top surface of the mattress of the bed that is rolled around a roller having an axis of rotation disposed beneath the portion of the mattress that lies atop the hospital bed protrudes forward into the semi-cylindrical cavity when the hospital bed is secured to the movable sanitary station, while permitting the top to extend over the mattress to cover a gap between the outer convex top surface of the rolled mattress and the back side of the cabinet, so that the top of the cabinet and a top of the mattress are aligned to permit a patient lying supine on the bed to be transported from the top of the mattress to the top of the cabinet without lifting or dropping the patient in elevation;

a locking mechanism provided on the back side of the cabinet for connecting the movable sanitary station to the hospital bed;

a set of wheels for supporting and moving the cabinet;

a toilet seat integrated in a central portion of the top of the cabinet and surrounding a first aperture formed through the top of the cabinet, wherein at least a portion of an exterior surface of the top of the cabinet is sloped inward toward the toilet seat from each of the right side, the left side, the front side and the back side downward toward the toilet seat;

a pair of leg chutes rotatably coupled to the cabinet near the junction of the top and the front side of the cabinet for supporting legs of the patient once the patient has been moved atop the toilet seat, wherein the pair of leg chutes further include a pair of corresponding knee supports coupled to the pair of leg chutes and that extend away from and above the pair of leg chutes and the top of the cabinet for supporting knees of the patient above the top of the cabinet when the patient has been moved to a cleaning position with a torso of the patient atop the bed and the legs of the patient with bent knees supported above the top of the cabinet by the pair of corresponding knee supports, wherein the pair of corresponding knee supports are rotatably coupled to a corresponding one of the pair of leg chutes near a midpoint of the pair of leg chutes, and wherein the pair of corresponding knee supports each terminate in a corresponding one of a pair of rollers at ends of the pair of corresponding knee supports away from the pair of leg chutes, whereby the one of the pair of rollers of the pair of corresponding knee supports can be rolled along a corresponding one of the legs of the patient and locked into position behind the bent knees of the patient once the one of the pair of rollers has reached a back of a knee of the corresponding leg;

a waste drawer that slides into a second aperture formed in one of the left side, the right side or the front side of the cabinet to capture waste that enters the first aperture through the top of the cabinet, and wherein the cabinet further comprises a sealed compartment inside the cabinet that is open only at the first aperture and the second aperture, wherein the second aperture is formed on the front side of the cabinet, and wherein the waste drawer slides through the front side of the cabinet to extend beneath the first aperture;

a water reservoir disposed within the cabinet;

a pump within the cabinet and coupled to the water reservoir for pumping water from the water reservoir;

a battery connector disposed on one of the front side, the back side, the right side or the left side of the cabinet for receiving a removable and rechargeable battery pack, wherein the battery connector is coupled to the pump for supplying operating current to the pump; and a hand-operated water sprayer disposed outside of the cabinet and coupled to the pump by a hose that extends into the cabinet.

12. A method of providing sanitation to a non-ambulatory patient, the method comprising:

moving a sanitary station including a cabinet having a front side, a back side, a right side, a left side, a bottom and a top, by rolling the cabinet over a set of wheels that support and move the cabinet;

pushing the sanitary station to a foot of a hospital bed so that a convex top surface of a mattress of the hospital bed that has been rolled around a roller protrudes into a concave shape forming a semi-cylindrical cavity having an axis extending laterally along the back side of the cabinet and at a height such that a maximum extension of the semi-cylindrical cavity toward the front side of the cabinet is located at a height beneath a portion of the mattress that lies atop the bed so that an outer convex top surface of the mattress of the bed that is rolled around a roller having an axis of rotation disposed beneath the portion of the mattress that lies atop the hospital bed protrudes forward into the semi-cylindrical cavity when the hospital bed is secured to the movable sanitary station;

covering a gap between the outer convex top surface of the rolled mattress and the back side of the cabinet so that the top of the cabinet and a top of the mattress are aligned to permit a patient lying supine on the bed to be transported from the top of the mattress to the top of the cabinet without lifting or dropping the patient in elevation;

providing a toilet seat integrated in a central portion of the top of the cabinet and surrounding a first aperture formed through the top of the cabinet; and moving the patient to a seated position atop the toilet seat by transporting the patient along the top of the mattress and onto the top of the cabinet without lifting or dropping the patient in elevation.

13. The method of claim 12, further comprising draining the top of the cabinet with a slope provided on an exterior surface of the top, wherein at least a portion of an exterior surface of the top is sloped inward toward the toilet seat from each of the right side, the left side, the front side and the back side downward toward the toilet seat.

14. The method of claim 13, further comprising:

removing waste by extracting a waste drawer that slides into a second aperture formed in one of the left side, the right side or the front side of the cabinet to capture waste that enters the first aperture through the top of the cabinet; and trapping any waste that escapes the waste drawer by providing a sealed compartment inside the cabinet that is open only at the first aperture and the second aperture.

15. The method of claim 14, wherein the second aperture is formed on the front side of the cabinet, so that the removing waste extracts a waste drawer that slides through the front side of the cabinet to extend beneath the first aperture.

16. The method of claim 12, further comprising:

storing cleaning water in a water reservoir disposed within the cabinet;

pumping water from the water reservoir with a pump within the cabinet and coupled to the water reservoir; and spraying water with a hand-operated water sprayer disposed outside of the cabinet and coupled to the pump by a hose that extends into the cabinet.

17. The method of claim 16, further comprising powering the pump with a removable battery pack inserted in a battery connector disposed on one of the front side, the back side, the right side or the left side of the cabinet.

18. The method of claim 12, further comprising locking the sanitary station to the hospital bed with a locking mechanism provided on the back side of the cabinet.

19. The method of claim 12, further comprising supporting legs of the patient with a pair of leg chutes rotatably coupled to the cabinet near the junction of the top and the front side of the cabinet, once the patient has been moved to the seated position atop the toilet seat, wherein the pair of leg chutes are rotatable between a first position in which the pair of leg chutes extend downward along the front of the cabinet, and a second position in which the pair of leg chutes are locked to extend in line with the top of the cabinet.

20. The movable sanitary station of claim 19, further comprising:

moving the patient to a cleaning position with a torso of the patient atop the bed and the legs of the patient above the top of the cabinet; and supporting bent knees of the patient above and away from the pair of leg chutes with a pair of knee supports coupled to a corresponding one of the pair of leg chutes that extend away from and above the corresponding one of the pair of leg chutes and the top of the cabinet to support the bent knees above the top of the cabinet from behind the bent knees.

21. A system for providing sanitation to a non-ambulatory patient, the method comprising:

a hospital bed including a flexible mattress, a frame having a pallet for supporting the flexible mattress and having legs extending to the floor and a roller affixed to a first end of the frame and having an axis of rotation disposed beneath a portion of the flexible mattress that lies on the pallet, whereby the foot of the flexible mattress is guided underneath the pallet and bends around the roller to a position underneath the pallet to move the patient; and a movable sanitary station including a cabinet having a front side, a back side, a right side, a left side, a bottom, and a top having a toilet seat integrated in a central portion thereof and surrounding a first aperture formed through the top of the cabinet wherein the back side of the cabinet has a concave shape forming a semi-cylindrical cavity having a central axis extending laterally along the back of the cabinet and at a height such that a maximum extension of the semi-cylindrical cavity toward the front side of the cabinet is located at a height beneath the portion of the flexible mattress that lies atop the hospital bed so that an outer convex top surface of the flexible mattress that is rolled around the roller protrudes forward into the semi-cylindrical cavity when the movable sanitary station is secured to the hospital bed, while permitting the top to extend over the flexible mattress to cover a gap between a top of the flexible mattress and the back side of the cabinet so that the top of the cabinet and a top of the flexible mattress are aligned to permit a patient lying supine on the bed to be transported from the top of the flexible mattress to the top of the cabinet without lifting or dropping the patient in elevation, wherein the movable sanitary station further includes a set of wheels for supporting and moving the cabinet.

22. The system of claim 21, wherein the movable sanitary station further comprises a pair of leg chutes rotatably coupled to the cabinet near the junction of the top and the front side of the cabinet for supporting legs of the patient once the patient has been moved atop the toilet seat, wherein the pair of leg chutes are rotatable between a first position in which the pair of leg chutes extend downward along the front of the cabinet, and a second position in which the pair of leg chutes are locked to extend in line with the top of the cabinet.

23. The system of claim 22, wherein the pair of leg chutes further include a pair of corresponding knee supports coupled to the pair of leg chutes and that extend away from and above the pair of leg chutes and the top of cabinet when the pair of leg chutes are locked in the second position for supporting knees of the patient above the top of the cabinet when the patient has been moved to a cleaning position with a torso of the patient atop the bed and the legs of the patient with bent knees supported above the top of the cabinet by the pair of corresponding knee supports.

* * * * *